US007837857B2

(12) United States Patent
Gautam et al.

(10) Patent No.: US 7,837,857 B2
(45) Date of Patent: Nov. 23, 2010

(54) HYDROCRACKING PROCESS FOR FABRICATING JET FUEL FROM DIESEL FUEL

(75) Inventors: Rajeev Gautam, Des Plaines, IL (US); William H. Keesom, Des Plaines, IL (US); Gavin P. Towler, Inverness, IL (US)

(73) Assignee: UOP LLC, Des Plaines, IL (US)

( * ) Notice: Subject to any disclaimer, the term of this patent is extended or adjusted under 35 U.S.C. 154(b) by 327 days.

(21) Appl. No.: 12/022,474

(22) Filed: Jan. 30, 2008

(65) Prior Publication Data

US 2009/0159494 A1 Jun. 25, 2009

Related U.S. Application Data

(60) Provisional application No. 61/009,002, filed on Dec. 24, 2007.

(51) Int. Cl.
*C10G 47/00* (2006.01)

(52) U.S. Cl. ..... 208/58; 208/108; 208/110; 208/111.3; 208/111.35

(58) Field of Classification Search ..... 208/58
See application file for complete search history.

(56) References Cited

U.S. PATENT DOCUMENTS 3,414,505 A * 12/1968 Chervenak et al. ..... 208/111.35
3,694,344 A * 9/1972 Munro ..... 208/58
5,954,941 A * 9/1999 Mercier et al. ..... 208/65

* cited by examiner

*Primary Examiner*—Glenn A Caldarola
*Assistant Examiner*—Michelle L Stein
(74) *Attorney, Agent, or Firm*—James C Paschall

(57) ABSTRACT

A method for obtaining jet fuel from diesel fuel is provided, the method comprising subjecting the diesel fuel to hydrocracking to convert at least a portion of the diesel fuel into a mixture of light hydrocarbons, kerosene, naphtha and a liquefied petroleum gas, isolating the kerosene, recovering jet fuel from the kerosene, subjecting at least a portion of the mixture of kerosene, naphtha and a liquefied petroleum gas to steam forming to obtain a synthesis gas containing hydrogen, and recycling hydrogen contained in the synthesis gas to the hydrocracking step. A modular system for performing the method is also provided.

19 Claims, 1 Drawing Sheet

HYDROCRACKING PROCESS FOR FABRICATING JET FUEL FROM DIESEL FUEL

CROSS-REFERENCE TO RELATED APPLICATIONS

This application claims priority under 35 U.S.C. §119(e) to U.S. patent application Ser. No. 61/009,002 filed Dec. 24, 2007, which is herein incorporated by reference in its entirety.

TECHNICAL FIELD

This disclosure relates generally to hydrocracking technology, and more specifically, to catalytic hydrocracking processes for converting diesel fuel into jet fuel.

BACKGROUND INFORMATION

Diesel is a common fuel product that is widely available worldwide, and is suitable as a fuel for variety of vehicles, such as trucks or ships, among others. Jet fuel, on the other hand, especially that of a quality making it suitable for aircraft, is not as widely available. There exists, therefore, a substantial demand for methods which would allow conversion of diesel fuel into jet fuel, for example, using catalytic hydrocracking.

Hydrocracking is a process combining catalytic cracking and hydrogenation of heavy feedstock, which is cracked in the presence of hydrogen to produce lighter products, e.g., isobutane for alkylation feedstock, and various other hydrogenated products. These products boil over a lower range of temperatures than the feed stock. The process is usually carried out under quite harsh conditions of high pressure and high temperature, and uses a catalyst. Traditional catalysts that are often employed include dual function catalysts that are useful for both acidic cracking (provided by a catalyst component that is an amorphous silica-alumina support or a crystalline zeolite material) and metallic hydrogenation (provided by a metal sulfide component incorporating such metals as nickel, tungsten, cobalt or molybdenum finely dispersed on the support material).

As the conversion of the hydrocracking processings increased, lighter (lower-boiling) products are formed. At low conversion the primary products are in the gas oil and diesel range. As conversion is increased more material is formed in the kerosene range, then in the naphtha range and finally in the range of butanes, propane and light hydrocarbons.

Because the lighter, lower-boiling compounds that are formed at higher conversion in a hydrocracking process contain more hydrogen per carbon atom than the feedstock, the hydrogen consumption of the process increases with the extent of conversion. Hydrogen for hydrocracking processes in oil refineries typically either comes from hydrogen that is produced as a byproduct of the catalytic reforming of heavy naphtha, or else hydrogen that is produced by steam reforming of either natural gas, refinery fuel gas or naphtha. The hydrogen that is produced in these processes is usually purified by pressure swing adsorption to achieve a hydrogen concentration greater than 99.9%, before being compressed to the pressure at which the hydrocracking process operates.

The hydrocracking process can be briefly outlined as follows. First, preliminarily heated feedstock is mixed with fresh and/or recycled hydrogen and sent to a reactor, where sulfur- and nitrogen-containing compounds are removed after being converted into hydrogen sulfide and ammonia. Limited hydrocracking also occurs at this stage. Next, the hydrocarbon is cooled, liquefied and run through a hydrocarbon separator. The hydrogen is recycled to the feedstock, and the liquid is run through a fractionator. The fractionator bottoms are again mixed with a hydrogen stream and the process is repeated.

Accordingly, catalytic hydrocracking is useful for converting the high molecular weight components in heavy petroleum distillates and involves the processes of hydrogenation and carbon-carbon bond cleavage. At the same time, at least a majority of oxygen, sulfur, and/or nitrogen-containing compounds, if any are present, are removed, and olefins are typically saturated to yield paraffins.

As described above, it is desirable to be able to convert diesel fuel into jet fuel. For example, during military or humanitarian operations there may be a greater local need for jet fuel than the available supply of jet fuel, whereas there may be a surplus of local diesel fuel available. In this situation, it may be desirable to convert diesel fuel into jet fuel using a modular plant that can be quickly assembled and is self-contained.

SUMMARY

We provide methods for obtaining a jet fuel product. One method comprises subjecting a diesel fuel to hydrocracking in the presence of a catalyst comprising a noble metal to convert at least a portion of the diesel fuel into the jet fuel product, followed by recovering the jet fuel product.

The catalyst may be based on a noble metal, such as palladium, platinum or the like. If desired, the catalyst can also be based on a base metal such as nickel, tungsten, molybdenum or the like.

We also provide systems for hydrocracking such a diesel fuel. One system comprises a hydrocracking module for converting at least a portion of the diesel fuel into a first mixture comprising a jet fuel product and a separation module in fluid communication with the hydrocracking module for recovering the jet fuel product from the mixture.

In one system, the separation module comprises a high-pressure separator in fluid communication with the hydrocracking module for separating the hydrogen-enriched gas from the mixture, a low-pressure separator in fluid communication with the high-pressure separator for separating a liquid stream comprising kerosene, naphtha and a liquefied petroleum gas, and a fractionator module in a fluid communication with the low-pressure separator for recovering the jet fuel product from the liquid stream.

Another system additionally includes a hydrogen generation module in a fluid communication with the fractionator for obtaining a synthesis gas from naphtha and a liquefied petroleum gas.

DETAILED DESCRIPTION

Figure 1:
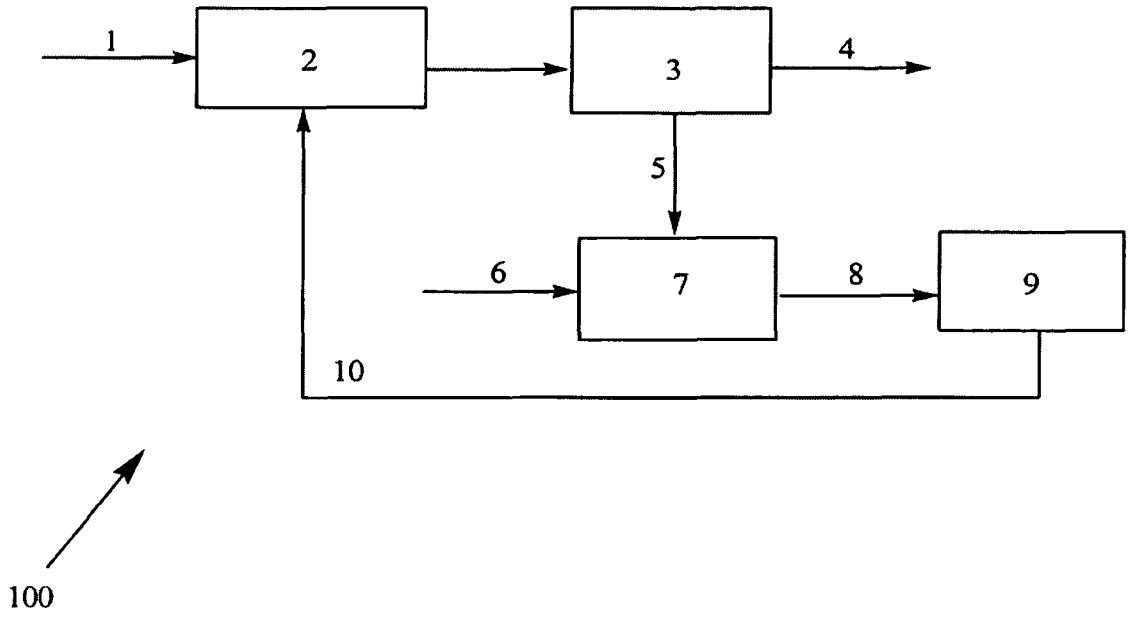
FIG. 1 is a block-diagram illustrating schematically a system for catalytic hydrocracking of diesel fuel for converting it into jet fuel.

The following definitions are used below, unless otherwise described:

The term "hydrocracking" refers to a process of substantially converting a diesel fuel into a jet fuel, the process comprising catalytic cracking and hydrogenation.

The term "steam reforming" refers to a process of reforming a compound, for example, a hydrocarbon such as methane, using water, producing synthesis gas (also known as "syngas").

The term "synthesis gas" refers to a gas mixture that contains varying amounts of carbon monoxide and hydrogen.

The term "a catalyst" is define as substance that changes the speed or yield of a chemical reaction without being itself substantially consumed or otherwise chemically changed in the process.

The term "a noble metal" refers to a metal that is highly resistant to corrosion or oxidation, and does not easily dissolve, as opposed to most base metals. Examples include, but are not limited to, platinum, palladium, gold, silver, and tantalum.

The term "a hydrocarbon" is defined as an organic the molecule of which consists only of carbon and hydrogen.

The term "a paraffin" is defined as a hydrocarbon identified by saturated carbon chains, which can be normal (straight), branched, or cyclic ("cycloparaffin"), and described by a general formula $C_nH_{2n+2}$ (for a non-cyclic paraffin) or $C_nH_{2n}$ (for a cycloparaffin) where n is an integer.

The term "an olefin," also known as "alkene" or "alkylene" is defined as compounds containing at least one carbon-carbon double bond (C=C).

The term "an aromatic compound" is defined to refer to a compound that includes a cyclically conjugated molecular entity with a stability, due to delocalization, significantly greater than that of a hypothetical localized structure, such as the Kelkulé structure. Aromatic compounds can be monocyclic, bicyclic and polycyclic and examples of aromatic moieties include, without limitation, phenyl, biphenyl, naphthyl, dihydronaphthyl, tetrahydronaphthyl, indenyl, indanyl, azulenyl, anthryl, phenanthryl, fluorenyl, pyrenyl and the like.

The term "a carbonium ion" is defined as an organic cation having one less electron than a corresponding free radical, and having a positive charge that may be, but not necessarily is, localized on the carbon atom.

The term "diesel fuel" is defined in accordance with the specifications defined in the American Society for Testing and Materials (ASTM). Specification D 975 and refers to a petroleum fraction comprised primarily of $C_{10}$-$C_{24}$ hydrocarbons (about 75 mass %), typically paraffins including straight-chained, branched, and cycloparaffins, and of aromatic hydrocarbons (about 25 mass %), such as alkylbenzenes and naphthalenes, and having distillation temperatures of about 260° C. at the 10% recovery point and about 340° C. at the 90% recovery point. The average net chemical formula for common diesel fuel is typically $C_{12}H_{26}$.

The term "jet fuel" is defined in accordance with the specifications defined in the ASTM Specification D 1655 and refers to a kerosene-based product having a maximum distillation temperature of about 200° C. at the 10% recovery point and a final maximum boiling point of about 300° C.

The term "kerosene" is defined as a petroleum fraction containing hydrocarbons that are slightly heavier than those found in gasoline and naphtha, such as $C_9$-$C_{16}$ hydrocarbons, and having a boiling point at ambient pressure between about 150° C. and about 300° C.

The term "naphtha" refers to a petroleum fraction with an approximate boiling range between about 50° C. and about 200° C.

The term "liquefied petroleum gas" or "LPG" refers to a mixture of low-boiling hydrocarbons that exists in a liquid state at ambient temperatures when under moderate pressures which are less than about 1.5 MPa and which comprises principally propane, propylene and butane.

A jet fuel product may be obtained by catalytic hydrocracking of a diesel fuel. The method comprises using the diesel fuel as feedstock and subjecting it to a process of catalytic hydrocracking, which includes reacting the diesel fuel with gaseous hydrogen, in the presence of a catalyst comprising a noble metal. The process may be conducted at a selected pressure and at a selected temperature, as described below.

One pressure range at which the process of hydrocracking can be conducted is between about 6 MPa and about 17 MPa, for example, between about 10 MPa and about 15 MPa, such as about 13 MPa. One temperature range at which the process of hydrocracking can be conducted is between about 200° C. and about 400° C., such as about 300° C. A desired rate of supply of hydrogen gas may be selected. For example, hydrogen gas can be supplied at a rate between about 350 and about 700 $m^3$ per 1 $m^3$ of the feedstock, i.e, of the diesel fuel used, for example, about 475 $m^3$ per 1 $m^3$ of the diesel fuel and/or recycled unconverted diesel fuel.

A variety of catalysts can be used for conducting the above-described process of hydrocracking. Thus, the catalyst that is used may be a noble metal-based catalyst comprising an amorphous or a zeolitic substrate having the noble metal incorporated within the substrate. Examples of noble metals that can be so incorporated include palladium and/or platinum. Alternatively, the catalyst may comprise some base metals, such as nickel, tungsten, molybdenum, combinations thereof, or the like.

Any diesel fuel that is commercially available can be used as feedstock in the processes described herein. One example of an acceptable diesel fuel that can be used may include about 75 mass % of paraffins including straight chained, branched, and cycloparaffins, and about 25 mass % of aromatic hydrocarbons, such as alkylbenzenes and naphthalenes. One representative example of an acceptable diesel fuel that can be used is a diesel fuel having distillation temperatures of about 260° C. at the 10% recovery point and about 340° C. at the 90% recovery point.

The product of catalytic hydrocracking of a diesel fuel described above is a complex mixture typically comprising a gaseous portion and a liquid portion. The specific composition of such a mixture, and the ratio between individual components contained therein will depend, among other factors, on the nature and the specific composition of the diesel fuel that is used. The gaseous portion may include residual unconverted hydrogen and light hydrocarbon gases such as methane, ethane and/or propane, and the liquid portion may include unconverted diesel, kerosene, naphtha and compounds such as butanes and propane that can be used to make a liquefied petroleum gas (LPG). The mixture can then be subject to the processes of separation and fractionation.

The process of separation and fractionation may be conducted in accordance with well known techniques. One exemplary process of separation and fractioning may be described as follows.

First, the hydrogen-enriched gas may be separated from the first mixture to generate a mixture comprising hydrogen, light hydrocarbons and a liquid stream, the liquid stream comprising unconverted diesel, kerosene, naphtha and an LPG. This process can be carried out at a pressure between about 6 MPa and about 17 MPa, for example, between about 9 MPa and about 12 MPa, such as about 10 MPa. The remainder of the mixture can then be further separated to obtain a blend of hydrogen and light hydrocarbons and a liquid stream that is substantially free of gaseous products, the liquid stream comprising diesel, kerosene, naphtha and an LPG. This process can be carried out at a pressure between about 0.3 MPa and about 3 MPa, for example, about 1.5 MPa.

Next, the liquid stream comprising diesel, kerosene, naphtha and an LPG may be then fractionated, by removing naphtha and an LPG as overhead product and diesel as bottom product, to recover the jet fuel as a result. Those skilled in the art can select the optimal conditions for carrying out the process of fractionating taking into account the need to accomplish separation in a minimal volume of equipment. For example, the fractionation can be achieved using conventional distillation, or, alternatively using a sequence of short distillation columns, or using intensified distillation columns known in the art.

The end point of the kerosene can be controlled by taking the bulk of the kerosene a few stages below the top of the column and bringing it into a side stripper column. The bottoms from the main fractionation can include residual uncracked diesel fuel which can be recycled back to the hydrocracking stage or be used as fuel in the process heaters. Following fractionation, the resulting jet fuel can be optionally further purified, for example, by treatment with an adsorbent, such as alumina, silica gel, activated carbon, or a zeolite.

The specific composition of the jet fuel obtained in the above-described process, and the ratio between individual components contained therein will depend, among other factors, on the nature and the specific composition of the diesel fuel that is used. One representative example of a jet fuel that can be obtained can have distillation temperatures of about 200° C. at the 10% recovery point and about 300° C. at the 90% recovery point.

As described above, the processes of hydrocracking and separation generate naphtha, LPG, and light hydrocarbons. The method can include an optional step of steam reforming these products, which can be conducted according to known techniques and protocols, to produce a synthesis gas comprising hydrogen, carbon monoxide, carbon dioxide and water. The steam reforming step is carried out by contacting the hydrocarbon feed with an excess of steam in the presence of a catalyst such as nickel on alumina at temperatures in excess of 750° C. Optionally, some quantity of a diesel fuel and/or gasoline can be also steam reformed. The synthesis gas produced as a result can serve as a source of hydrogen to be used in the step of hydrocracking. Alternatively, the synthesis gas can be diverted to other uses.

If hydrogen obtained in the process of steam reforming is used for hydrocracking, it may optionally be purified prior to such a use. The process of purification includes separating the hydrogen that is a part of the synthesis gas obtained during steam reforming from other components (i.e., CO and $CO_2$) of the synthesis gas. Purification can be carried out using known methods and techniques. One such method that may be used for purification is pressure swing adsorption (PSA). Another method that may be used for purification is solvent scrubbing, which includes removing $CO_2$ by contacting the synthesis gas with a solvent such as methanol, monoethanolamine or a glycol.

The process of solvent scrubbing can be carried out under conditions known in the art, for example, at a temperature between about −20° C. and about 80° C., and a pressure of about 1 MPa or higher. The process of solvent scrubbing can be can be optionally followed by methanation, i.e., removing CO by reacting (CO with hydrogen to obtain methane. Methanation can be carried out under conditions known in the art, for example, at a temperature above about 300° C., such as between about 300° C. and about 700° C., and a pressure of between about 100 KPa and about 10 MPa, in a presence of a suitable catalyst, such as nickel dispersed on alumina.

The three-step process of conversion of a diesel fuel described above (i.e., hydrocracking, separation and steam reforming) can be carried out in a modularized plant, so that the combined plant can be shipped and assembled near a source of diesel fuel, or near the point of consumption of the resulting jet fuel simplifying logistics in either case. Alternatively, the process can be carried in an apparatus comprising a hydrocracker, a separator and a steam reformer assembled and held together to form a single unit.

Further, referring to FIG. 1, we provide an exemplary system that can be used for carrying out our methods. Such a system may be shown as a block diagram by FIG. 1 and can be described as follows. The system 100 includes the hydrocracking zone 2, in which hydrocracking of the diesel fuel in the presence of hydrogen and a catalyst is conducted. The diesel feed 1 may be heated, for example, by using a heat exchanger network (not shown), to a desired temperature, prior to the introduction of the diesel fuel into the hydrocracking zone 2. The temperature to which the diesel fuel may be heated can be selected by those having ordinary skill in the art, and may generally be between about 200° C. and about 400° C., such as about 300° C.

The hydrogen may be heated separately in the same or a separate heat exchanger network and then introduced into the hydrocracking zone 2 as a stream (not shown) separate from that of the diesel fuel. Alternatively, hydrogen may be premixed with the diesel fuel, and/or optionally also with recycled uncracked diesel fuel, followed by heating the mixture and the introduction of the heated mixture into the hydrocracking zone 2 as a combined feed. Hydrogen may be introduced at a rate discussed above, such as at 350 and about 700 $m^3$ per 1 $m^3$ of the feedstock, i.e, of the diesel fuel used, for example, about 475 $m^3$ per 1 $m^3$ of the diesel fuel and/or recycled unconverted diesel fuel.

The catalyst may be introduced into the hydrocracking zone 2, and the process of hydrocracking starts when the catalyst comes into contact with the diesel fuel/hydrogen feed that may be maintained at the desired temperature and pressure. The pressure may be maintained at a level between about 6 MPa and about 17 MPa, for example, between about 10 MPa and about 15 MPa, such as about 13 MPa.

As a result of the above-described process of hydrocracking at least a portion of the diesel fuel may be converted into a mixture comprising light hydrocarbons and a liquid composition comprising kerosene, naphtha and a liquefied petroleum gas. This mixture may be directed to the product separation zone 3. In the product separation zone 3, a liquid portion of the mixture that includes kerosene, naphtha and a liquefied petroleum gas can be separated and fractionated as described above, to yield a stream of a kerosene product 4 and the remainder stream 5.

Thus, the kerosene product may be isolated as the stream 4, which can be used as jet fuel. Alternatively, the kerosene product 4 may be in addition further processed to recover jet fuel. The process of recovery of jet fuel (not shown) may be conducted as described above, i.e., by using optional further purification, such as, by treating the kerosene product 4 with an adsorbent, such as alumina, silica gel, activated carbon, or a zeolite.

The remainder stream 5 may be optionally directed to the steam reforming zone 7 where it may be steam reformed using steam or water 6, to obtain a synthesis gas 8 containing hydrogen. Synthesis gas 8 may be purified in the purification zone 9, as described above, for example, by utilizing the process of pressure swing adsorption (PSA) or solvent scrubbing, and a purified hydrogen may be obtained thereby. The purified hydrogen may then be recycled, for example, by directing the stream of purified hydrogen 10 into the hydrocracking zone 2, where the purified hydrogen may be used in the initial hydrocracking step. The entire process may then be repeated as many times as needed.

Although our methods and systems have been described with reference to the above-discussed reactions and structures, it will be understood that modifications and variations are encompassed within the spirit and scope of the disclosure as defined in the appended claims.

What is claimed is:

1. A method for obtaining jet fuel from diesel fuel, comprising:

(a) subjecting the diesel fuel to hydrocracking in the presence of a catalyst and hydrogen to convert at least a portion of the diesel fuel into a first mixture comprising light hydrocarbons and a liquid composition comprising kerosene, naphtha and a liquefied petroleum gas;

(b) isolating the kerosene from the liquid composition;

(c) recovering jet fuel from the kerosene; and (d) subjecting at least a portion of the liquid composition including gasoline to steam reforming to obtain a synthesis gas containing hydrogen; and (e) recycling hydrogen from step (d) to the hydrocracking step (a).

2. The method of claim 1, wherein the step of isolating the kerosene further comprises:

(f) removing hydrogen-enriched gas from the first mixture to generate a second mixture comprising hydrogen, light hydrocarbons and the liquid composition;

(g) separating the second mixture to obtain (i) a third mixture comprising hydrogen and light hydrocarbons and (ii) the liquid composition that is substantially free of gaseous products; and (h) fractionating the liquid composition that is substantially free of gaseous products, to isolate the kerosene thereby.

3. The method of claim 1, wherein the step of recovering the jet fuel further includes distilling the kerosene isolated from the liquid composition.

4. The method of claim 3, further comprising purifying the kerosene isolated from the liquid composition.

5. The method of claim 1, further comprising obtaining a purified hydrogen prior to the recycling step (e).

6. The method of claim 1, further comprising mixing an unconverted diesel fuel with the naphtha and the liquefied petroleum gas obtained in the step of fractionating prior to the steam-reforming.

7. The method of claim 5, further comprising utilizing the hydrogen portion of the synthesis gas in the step of hydrocracking.

8. The method of claim 1, wherein the diesel fuel has distillation temperatures of about 260° C. at the 10% recovery point and about 340° C. at the 90% recovery point.

9. The method of claim 1, wherein the jet fuel has the maximum distillation temperature of about 200° C. at the 10% recovery point and the final maximum boiling point of about 300° C.

10. The method of claim 1, wherein the hydrocracking is carried out at the pressure between about 6 MPa and about 17 MPa.

11. The method of claim 1, wherein the hydrocracking is carried out at the temperature between about 200 and about 400° C.

12. The method of claim 1, wherein the catalyst comprises an amorphous or a zeolitic substrate and a noble metal incorporated within the substrate, wherein the noble metal is at least one selected from the group consisting of palladium and platinum.

13. The method of claim 1, wherein the hydrocracking includes supplying hydrogen at a rate of between about 350 and about 700 $m^3$ per 1 $m^3$ of the diesel fuel and/or recycled unconverted diesel fuel.

14. A system for hydrocracking a diesel fuel, comprising:

(a) a hydrocracking module that converts at least a portion of the diesel fuel and hydrogen into a first mixture of light hydrocarbons and a liquid composition comprising kerosene, naphtha and a liquefied petroleum gas; and (b) a separation module in fluid communication with the hydrocracking module for recovering the jet fuel from the liquid composition; and (c) a steam reforming module in fluid communication with the separation module for converting the liquid composition including gasoline to hydrogen, said hydrocracking module being in communication with said steam reforming module.

15. The system of claim 14, further comprising a device that maintains a pressure between about 6 MPa and about 17 MPa in the hydrocracking module.

16. The system of claim 14, wherein the separation module comprises:

(a) a high-pressure separator in fluid communication with the hydrocracking module that separates the hydrogen-enriched gas;

(b) a low-pressure separator in fluid communication with the high-pressure separator that separates the liquid composition and obtains the liquid composition that is substantially free of gaseous products; and (c) a fractionator module in a fluid communication with the low-pressure separator that recovers the jet fuel from the liquid composition.

17. The system of claim 16, further comprising a device that maintains a pressure between about 6 MPa and about 17 MPa in the high-pressure separator.

18. The system of claim 16, further comprising a device that maintains a pressure between about 0.3 MPa and about 3 MPa in the low-pressure separator.

19. The system of claim 16, further comprising a hydrogen generation module in fluid communication with the fractionator for obtaining a synthesis gas from the naphtha and the liquefied petroleum gas.

* * * * *